US006792710B2

(12) United States Patent
Whitlow et al.

(10) Patent No.: US 6,792,710 B2
(45) Date of Patent: Sep. 21, 2004

(54) PICTURE FRAME SYSTEM

(76) Inventors: Forest P. Whitlow, 8014 Horse Chestnut La., Charlotte, NC (US) 28277; Joyce T. Whitlow, 8014 Horse Chestnut La., Charlotte, NC (US) 28277

( * ) Notice: Subject to any disclaimer, the term of this patent is extended or adjusted under 35 U.S.C. 154(b) by 0 days.

(21) Appl. No.: 09/389,002

(22) Filed: Sep. 2, 1999

(65) Prior Publication Data

US 2002/0148151 A1 Oct. 17, 2002

Related U.S. Application Data

(60) Provisional application No. 60/099,133, filed on Sep. 4, 1998.

(51) Int. Cl.[7] ..... A47G 1/06
(52) U.S. Cl. ..... 40/768; 40/781; 40/792
(58) Field of Search ..... 40/777, 792, 653, 40/781, 790, 796, 768, 795

(56) References Cited

U.S. PATENT DOCUMENTS 1,334,780 A * 3/1920 Morgan ..... 40/795
RE25,182 E * 6/1962 Larson
3,665,627 A * 5/1972 MacCluney
5,307,574 A * 5/1994 Huff, Jr. ..... 40/781
5,335,434 A * 8/1994 Shultz et al. ..... 40/792 X
5,524,370 A * 6/1996 Roy ..... 40/768 X
5,659,990 A * 8/1997 Henneman et al. ..... 40/790 X
5,815,971 A * 10/1998 Rothe et al. ..... 40/790 X

* cited by examiner

*Primary Examiner*—Joanne Silbermann
(74) *Attorney, Agent, or Firm*—Kilpatrick Stockton LLP

(57) ABSTRACT

A back member of a picture frame includes a platform and a retainer mechanism. The picture frame has interior walls that form an interior cavity. The platform includes retaining walls, and the platform and the retaining walls are adapted to fit within the interior cavity of the picture frame. The retainer mechanism is disposed relative to one of the retaining walls so as to provide a force to releasably engage one of the retaining walls against one of the interior walls. The retainer mechanism provides a one-step, quick release engagement and disengagement of the back member and the picture frame. The retainer mechanism may include an elastic spring element or a gasket-like elastic material. In another embodiment, a system for framing a display piece is also disclosed. The system includes a frame, a back member engageable with the frame, and a retainer mechanism for maintaining engagement between the frame and the back member. The retainer mechanism allows one-step, quick-release engagement and disengagement of the back member from the frame. The retainer mechanism may also hold the display piece in a desired position within the system.

19 Claims, 4 Drawing Sheets

PICTURE FRAME SYSTEM

CROSS-REFERENCE TO RELATED APPLICATIONS

This application claims the benefit of Provisional Application No. 60/099,133, filed Sep. 4, 1998.

FIELD OF THE INVENTION

The present invention relates to a frame for pictures and artwork, and more particularly, to a picture retaining system and method of making same.

BACKGROUND

It is often difficult to secure a picture within a framing unit, and/or remove a picture from a framing unit due to the complex arrangements required to hold the framing unit together and secure the picture in place. Traditional picture frames usually comprise two or more rectangular main pieces, such as a frame, a piece of glass or other transparent material and a back piece. The glass is usually contained within the frame, and a picture is placed on the glass and held in place by the back piece. The back piece may be slid in place or otherwise secured within the frame to prevent the picture from misalignment within, or falling out of, the framing unit.

Numerous mechanisms have been utilized to secure the back piece and/or picture in place within the frame. One common securing mechanism utilizes rotatable tabs attached to the frame. The tabs can be adjusted to clamp the back piece and picture within the frame, or they can be released and rotated out of the way to remove the picture. Some framing units require strips of thick paper, cardboard, curved pieces of metal, etc. to be placed behind the picture to wedge the back piece against a lip in the frame. These types of securing mechanisms are often awkward and unmanageable because of the numerous pieces involved, and ineffective because of the tendency of the pieces to slip out of position.

Additionally, some framing units that securely hold a picture in place disadvantageously have permanent or semi-permanent securing mechanisms. For example, some require staples, screws, or nails to secure the pieces of the frame unit together. In addition to providing a complex problem if removal of the picture is desired, these securing mechanisms may damage the frame material. Other types of framing units, such as those utilized for many prints, have a backing of stiff paper, cardboard, or thin wood attached permanently to the back of the frame. This type of backing is not designed to be removed and any attempt to do so may cause damage to the framing unit.

Thus, the traditional framing units present difficulty in securing a picture within and/or removing a picture from the framing unit. Therefore, there is a need for a picture framing unit that has a quick, simple and reliable mechanism for securing and removing a picture.

SUMMARY OF THE INVENTION

The aforementioned problems are resolved by a back member of a picture frame. The picture frame has interior walls that form an interior cavity. The back member includes a platform and a retainer mechanism. The platform includes retaining walls, and the platform and the retaining walls are adapted to fit within the interior cavity of the picture frame. The retainer mechanism is disposed within one of the retaining walls, and the retainer mechanism provides a force to releasably engage one of the retaining walls against one of the interior walls. The retainer mechanism provides a one-step, quick release engagement and disengagement of the back member and the picture frame. The retainer mechanism may include an elastic spring element or a gasket-like elastic material.

A system for framing a display piece is also disclosed. The system includes a frame, a back member engageable with the frame, and a retainer mechanism for maintaining engagement between the frame and the back member. The retainer mechanism allows one-step, quick-release engagement and disengagement of the back member from the frame. The retainer mechanism may also hold the display piece in a desired position within the system.

DETAILED DESCRIPTION OF THE INVENTION

Figure 1:
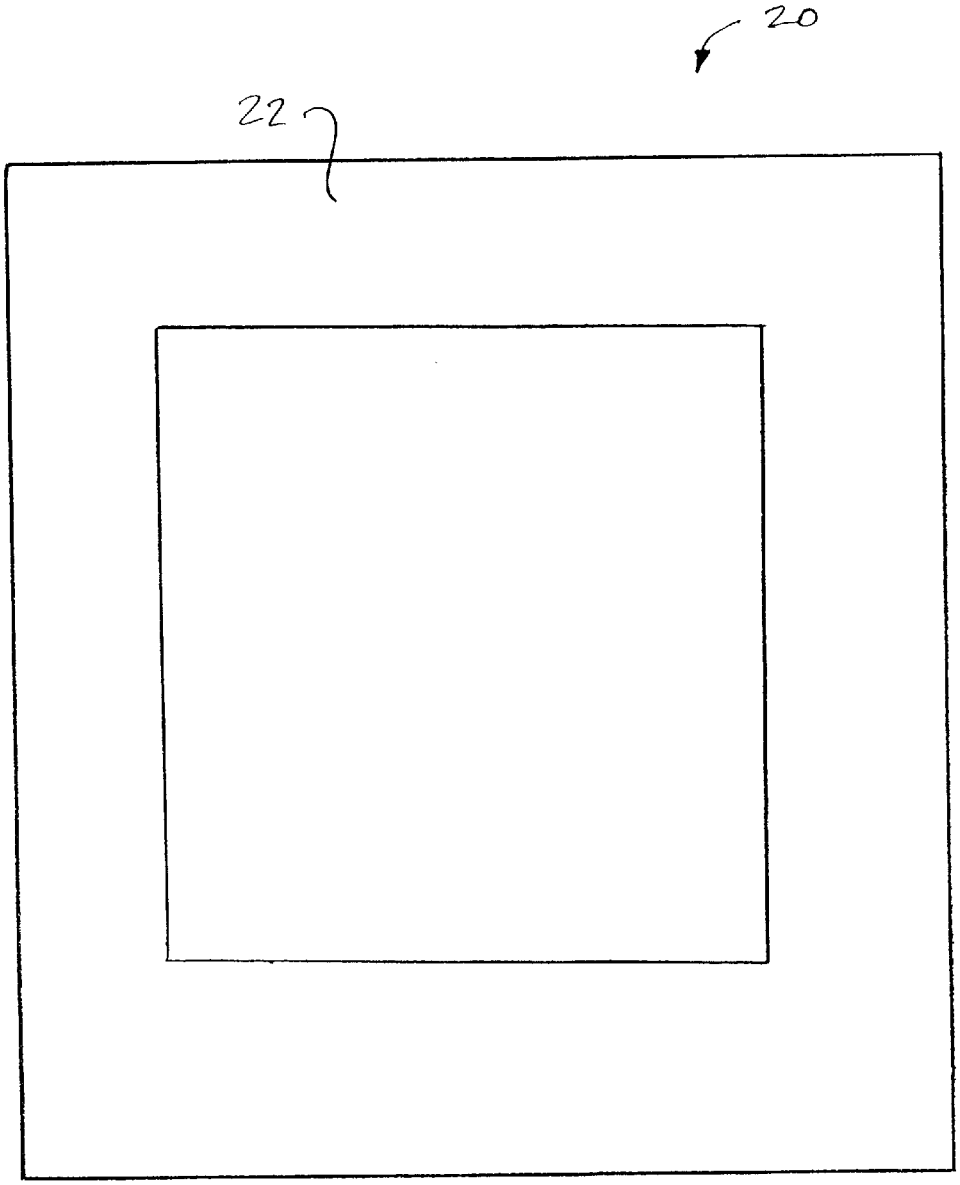
FIG. 1 is a front view of the framing system of the present invention.
Figure 2:
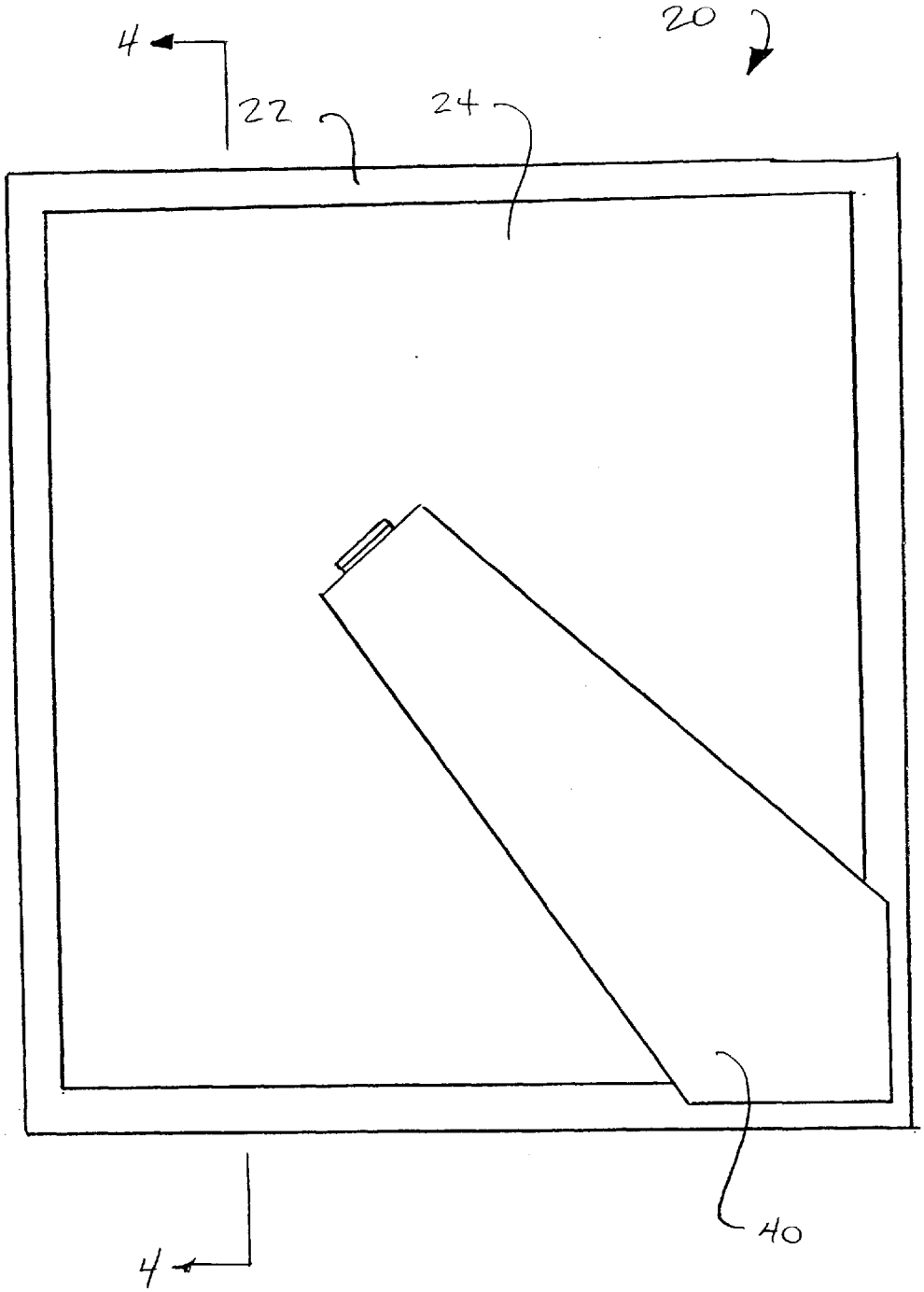
FIG. 2 is a rear view of the present invention.
Figure 3:
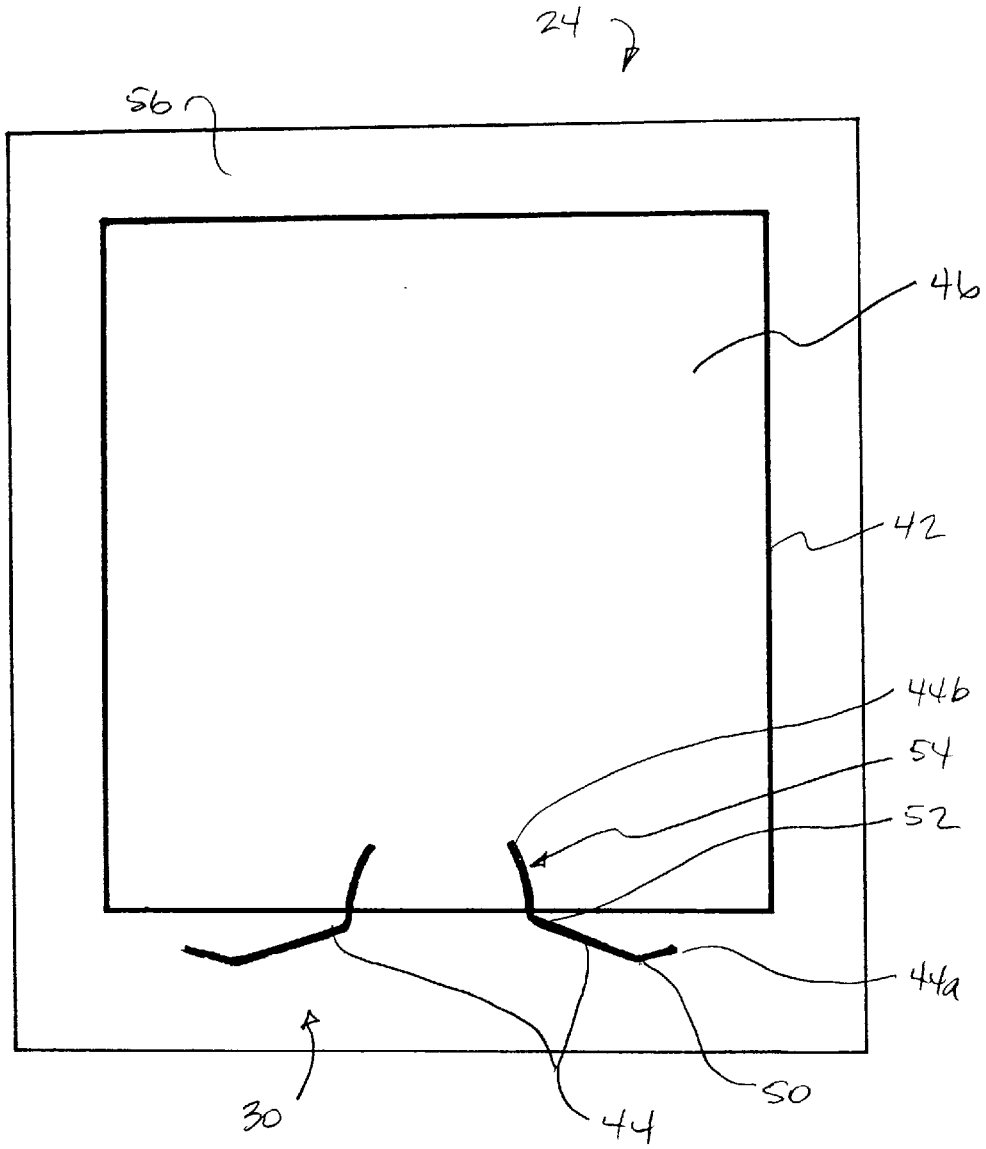
FIG. 3 is a front view of the back member of the present invention, including the quick-release retainer mechanism.
Figure 4:
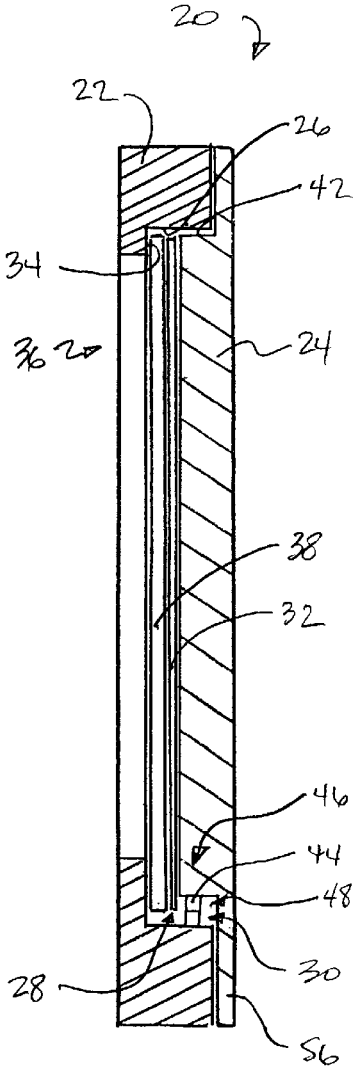
FIG. 4 is a cross-sectional view along line 4—4 in FIG. 2.

The present invention is a picture framing system comprising a frame, a back member, and a quick-release retainer mechanism that advantageously maintains frame and back member in a releasable engagement. The quick-release feature of retainer mechanism provides a spring force in the plane of the framing system that allows a one-step engagement or disengagement of the frame and back member. A display piece, such as pictures and artwork, can be easily and swiftly disposed within the framing system. Retainer mechanism maintains the engagement of frame and back member and holds the display piece in position within the framing system Thus, retainer mechanism dramatically improves the ease of installing or removing the display piece from the picture framing system.

The quick-release retainer mechanism of the present invention provides a spring force that releasably engages frame and back member. The spring force of retainer mechanism is in a direction within the plane of the framing system, causing the engagement of the frame and back member at opposing surfaces that are non-parallel to the plane of the framing system. As one skilled in the art will realize, this beneficial quick-release retainer mechanism may comprise numerous embodiments. A number of examples of such embodiments are described below, however, these examples are not intended to be limiting. Also, similar elements have the same reference numeral in these various embodiments.

According to one embodiment of the present invention, referring to FIGS. 1–4, a picture framing system 20 comprises a frame 22 and a back member 24 sized to fit within interior walls 26 that form interior cavity 28 of the frame. A quick-release retainer mechanism 30 (FIGS. 3 and 4) provides a spring force in the plane of framing system 20 to maintain frame 22 and back member 24 in a releasable engagement. Back member 24 may support a display piece 32, such as a picture or artwork, against a ledge 34 in frame 22 that forms a viewing area 36. Alternatively, display piece 32 may be disposed between a transparent member 38, such a glass or plastic, and back member 24, where the back member maintains the relative positioning of the various components of framing system 20. Additionally, framing system 20 may comprise support member 40, such as a hinged leg or other well-known support, that enables the framing system to be displayed in a standing position.

Retainer mechanism 30 advantageously engages at least one frame interior wall 26 against at least one opposing back member retaining wall 42. Typically, retainer mechanism 30 is located on one end of backing member 24 and engages interior wall 26 and retaining wall 42 at the opposite end. The elasticity of retainer mechanism 30 enables frame 22 and back member 24 to maintain engagement in any orientation. In this embodiment, retainer mechanism 30 comprises at least one spring element 44, that may be formed with spring steel, plastic, or other similar resilient material. Alternatively, retainer mechanism 30 may be integrally formed with back member 24 and/or frame 22, such as in a plastic molding or as a metal insert within a plastic or rubber molding. Retainer mechanism 30 is fixed within a platform 46 formed by retaining walls 42. As one skilled in the art will realize, however, retainer mechanism 30 may be alternatively affixed to frame 22, or the retainer mechanism may be independently positioned between frame 22 and back member 24.

Retainer mechanism 30 is disposed within gap 48 between an interior wall 26 and a retaining wall 42 of platform 46. Platform 46 is adapted to fit within interior cavity 28 and to support display piece 32 against transparent member 38 and/or ledge 34. Gap 48 is sized to allow retainer mechanism 30 to deform to provide the spring force to maintain the engagement of frame 22 and back member 24. Spring element 44 is bent to facilitate placement of back member 24 within frame 22 and to provide sufficient spring force to maintain engagement upon deformation. Distal bend 50 allows tip 44*a* of spring element 44 to displace along an arc upon deformation without getting caught up along interior wall 26. Proximal bend 52 insures the spring force generated by the deformation of spring element 44 engages at least one retaining wall 42 against an opposing interior wall 26 that enables framing system 20 to be held together at any orientation. The near end 44*b* of spring member 44 is fixed within platform 46, preferably in a permanent but possibly in a removable manner. For example, spring member 44 may be press fit, glued, clamped or loosely disposed within a slot 54 in platform 46.

Slot 54 may be at any orientation, but is angled in this embodiment to increase the surface area within the slot for absorbing the spring force of the deformed spring member 44. Additionally, slot 54 is advantageously at an angle to the direction of the spring force and the direction of the deformation of spring member 44, which helps to keep spring member 44 from becoming displaced from slot 54.

Suitable materials for frame 22 and back member 24 include any substantially rigid material that maintains its configuration under the applied spring force supplied by retainer mechanism 30. For example, frame 22 and back member 24 may comprise metal, wood, cork, plastic, hard rubber compounds, and other similar materials.

In operation, back member 24 is positioned to align platform 46 over interior cavity 28. Retainer mechanism 30 is positioned between an interior wall 26 of frame 22 and a retaining wall 42 of platform 46. In this embodiment, back member 24 is displaced to deform spring element 44 against interior wall 26. The displacement of back member 24 continues until retainer wall 42 on the opposite side of platform 46 from retainer mechanism 30 is within interior cavity 28. At this point, back member 24 is pressed inwardly and released, thereby engaging the surfaces of interior wall 26 and retaining wall 42 on the opposite end of platform 46 from retainer mechanism 30. Back member 24 may be pressed inwardly until sufficient contact is made between interior wall 26 and retaining wall 42 to enable the components of framing system 20 to be held together, or until the forward surface of platform 46 contacts ledge 34 or until back member flange 56 contacts the rear surface of frame 20. As mentioned above, transparent member 38 and/or display piece 32 may be positioned within interior cavity 28 between platform 46 and ledge 34. Quick-release mechanism 30 of the present invention allows displays piece 32 and/or transparent member 38 to be quickly and easily installed or removed from framing system 20.

Figure 5:
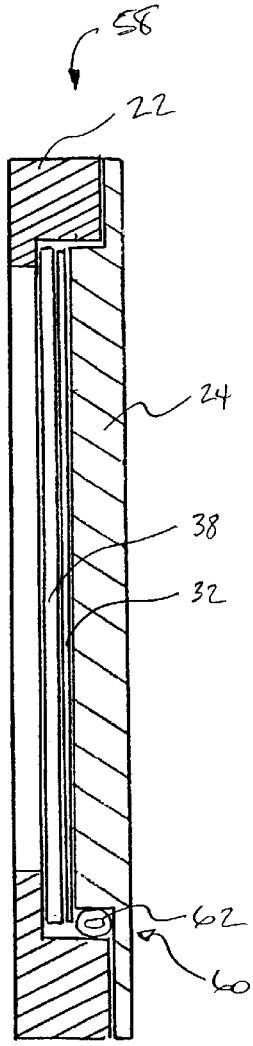
FIG. 5 is a cross-sectional view, similar to FIG. 4, of another embodiment of the present invention.

In another embodiment, referring to FIG. 5, framing system 58 comprises frame 22, back member 24 and a quick-release mechanism 60 that may comprise rubber tubing 62, or other similar gasket-like elastic material, disposed between back member 24 or frame 22. Rubber tubing 62 provides a spring force in the plane of framing system 58 to releasably engage frame 22 and back member 24.

Although the invention has been described with reference to these preferred embodiments, other embodiments can achieve the same results. Variations and modifications of the present invention will be apparent to one skilled in the art and the above disclosure is intended to cover all such modifications and equivalents.

What is claimed is:

1. A picture frame, comprising:

flat interior walls that form an interior cavity;

a back member comprising a platform having ends with retaining walls, the platform and the retaining walls adapted to fit within the interior cavity of the picture frame; and a retainer mechanism disposed within one of the retaining walls and detached from the back member at one end of the retainer mechanism, wherein when the back member is pressed inwardly into the picture frame and released, the retainer mechanism is deformed, thereby providing a force to releasably engage the retaining wall on the opposite end of the platform from the retainer mechanism against an adjacent interior wall.

2. The back member of claim 1, wherein the retainer mechanism provides a one-step, quick release engagement and disengagement of the back member and the picture frame.

3. The back member of claim 1, wherein the retainer mechanism comprises a spring element.

4. The back member of claim 1, wherein the retainer mechanism provides sufficient spring force to maintain engagement of one of the retaining walls against one of the interior walls upon deformation.

5. A system for framing a display piece, the system comprising:

a frame having flat interior walls that form an interior cavity;

a back member comprising a platform having ends with retaining walls, the platform and the retaining walls engageable with the interior cavity of the frame; and a retainer mechanism disposed within one of the retaining walls and detached from the back member at one end of the retainer mechanism, wherein when the back member is pressed inwardly into the picture frame and released, the retainer mechanism is deformed, allowing one-step, quick-release engagement of the back member with the frame, and wherein releasing the retainer mechanism from being deformed allows one-step, quick-release disengagement of the back member with the frame.

6. A system for framing a display piece according to claim 5, wherein the retainer mechanism holds the display piece in a desired position within the system.

7. A system for framing a display piece according to claim 5, wherein the frame defines a plane of the system, and the retainer mechanism provides a force in the plane that allows the one-step, quick-release engagement and disengagement of the back member from the frame.

8. A system for framing a display piece according to claim 5, wherein the frame defines a plane of the system, and the retainer mechanism provides a spring force in the plane that allows the one-step, quick-release engagement and disengagement of the back member from the frame.

9. A system for framing a display piece according to claim 5, wherein the frame defines a plane of the system, and the retainer mechanism engages the frame and the back member at opposing surfaces that are not parallel to the plane.

10. A system for framing a display piece, the system comprising:

a frame, the frame having at least one flat, interior wall that defines an interior cavity of the frame, the frame defining a plane of the system;

a back member engageable with the frame, the back member having at least one retaining wall, the at least one retaining wall opposing the at least one flat, interior wall of the frame; and a retainer mechanism disposed within the at least one retaining wall and detached from the back member at one end of the retainer mechanism, wherein when the back member is pressed inwardly into the picture frame and released, the retainer mechanism is deformed to provide a force in the plane that allows one-step, quick-release engagement of the back member with the frame, and wherein releasing the retainer mechanism from being deformed allows one-step, quick-release disengagement of the back member with the frame.

11. A system for framing a display piece according to claim 10, wherein the retainer mechanism is disposed between an interior wall and an opposing retaining wall.

12. A system for framing a display piece according to claim 10, wherein the frame has a first interior wall and the back member has a first retaining wall, with the first retaining wall engaging the first interior wall, and the force provided by the retainer mechanism allows one-step, quick-release engagement and disengagement of the first retaining wall from the first interior wall.

13. A system for framing a display piece according to claim 12, wherein the frame has a second interior wall and the back member has a second retaining wall, with the second interior wall opposing the second retaining wall, and the retainer mechanism is disposed between the second interior wall and the second retaining wall.

14. A system for framing a display piece according to claim 10, wherein the retainer mechanism comprises a spring element.

15. A system for framing a display piece according to claim 14, wherein the spring element includes a end attachable to the back member.

16. A system for framing a display piece according to claim 14, wherein the spring element includes an end press-fit to the back member.

17. A system for framing a display piece according to claim 14, wherein the spring element includes a distal portion, the distal portion shaped to reduce contact with the frame.

18. A system for framing a display piece according to claim 10, wherein the retainer mechanism is deformable.

19. A system for framing a display piece according to claim 18, wherein the retainer mechanism provides sufficient spring force to maintain engagement of one of the retaining walls against one of the interior walls upon deformation.

* * * * *